US008054000B2

(12) United States Patent
Mizojiri et al.

(10) Patent No.: US 8,054,000 B2
(45) Date of Patent: Nov. 8, 2011

(54) FLASH LAMP IRRADIATION APPARATUS

(75) Inventors: Takafumi Mizojiri, Hyogo (JP); Yukihiro Morimoto, Hyogo (JP); Tetuya Torikai, Hyogo (JP)

(73) Assignee: Ushio Denki Kabushiki Kaisha, Tokyo (JP)

( * ) Notice: Subject to any disclaimer, the term of this patent is extended or adjusted under 35 U.S.C. 154(b) by 1890 days.

(21) Appl. No.: 11/143,574

(22) Filed: Jun. 3, 2005

(65) Prior Publication Data

US 2006/0038505 A1 Feb. 23, 2006

(30) Foreign Application Priority Data

Jun. 3, 2004 (JP) ..... 2004-166231

(51) Int. Cl.
*H05B 41/00* (2006.01)

(52) U.S. Cl. ..... 315/246; 315/50; 315/276; 315/312; 315/309

(58) Field of Classification Search ..... 313/45, 313/537, 581, 594, 595, 601, 602, 607, 619–631; 315/46–50, 64–69, 94–107, 112–118, 309
See application file for complete search history.

(56) References Cited

U.S. PATENT DOCUMENTS

| | | | | |
|---|---|---|---|---|
| 5,889,366 | A * | 3/1999 | Yokokawa et al. | 313/607 |
| 5,965,988 | A * | 10/1999 | Vollkommer et al. | 315/246 |
| 2004/0178731 | A1 * | 9/2004 | Takeda et al. | 313/607 |

FOREIGN PATENT DOCUMENTS

| | | | |
|---|---|---|---|
| JP | 2001-185088 | A | 7/2001 |
| JP | 2002-231488 | A | 8/2002 |
| JP | 2003-288861 | A | 10/2003 |
| JP | 2003-289049 | | 10/2003 |
| JP | 2004-031643 | A | 1/2004 |
| JP | 2004-184478 | A | 7/2004 |
| JP | 2005-071898 | A | 3/2005 |
| JP | 2005-071942 | A | 3/2005 |

OTHER PUBLICATIONS

Office Action from the Japanese Patent Office for application No. 2004-166231 dated May 19, 2010.

* cited by examiner

*Primary Examiner* — Tuyet Thi Vo
(74) *Attorney, Agent, or Firm* — Rader, Fishman & Grauer PLLC

(57) ABSTRACT

A flash lamp irradiation apparatus comprises at least one flash lamp having a bulb made of translucent material, two or more trigger members disposed along a tube axis of the at least one flash lamp, wherein voltage is simultaneously impressed to the two or more trigger members at lighting in order to emit light from the at least one flash lamp.

10 Claims, 5 Drawing Sheets

Sectional View
Taken Along Line IB-IB

| Distance between Lamp and Light Irradiated Surface (mm) | Illuminance Increasing Rate in case of 3 Trigger Members (%) |
|---|---|
| 48 | 11.3 |
| 50 | 10.8 |
| 100 | 5.2 |
| 150 | 3.4 |
| 200 | 2.5 |

FLASH LAMP IRRADIATION APPARATUS

FIELD OF THE INVENTION

The present invention relates to a flash lamp irradiation apparatus, which is used, for example, in a manufacturing process of a semiconductor, or a liquid crystal display, etc.

DESCRIPTION OF THE RELATED ART

Conventionally a heating apparatus for heating a substrate, such as a silicon wafer, by light emission has been known.

In a semiconductor manufacturing process, rapid heating, high temperature maintenance, forced cooling of a wafer, etc. are performed, and the a heating apparatus is used in wide range, such as film forming (an oxide film is formed in a wafer surface), and diffusion (impurities are diffused inside a wafer). As to diffusion, ions of boron or arsenic are implanted into silicon crystal in the surface portion of a silicon wafer, and the impurities are diffused by performing heat treatment of, for example, 1000 degrees Celsius or more to the silicon wafer in this state.

As such an apparatus for performing heat-treatment to a silicon wafer, a RTP (Rapid Thermal Process) is known, in which a lamp is used as a source of heating, in order to rapidly heating the silicon wafer by irradiating light emitted from the source for heating to the wafer, and the silicon wafer can be rapidly cooled down after that. In such an apparatus, a halogen lamp is used as a source of heating.

However, in recent years, higher integration and more minimization of a semiconductor integrated circuit is increasingly required. For example, in recent years it is required to form impurity diffusion in a shallow portion in a 20 nm or less depth. In the apparatus which uses the halogen lamp as the source of heating, although it is possible to process in the depth of 25-30 nm level, the above-mentioned depth hardly meets the needs.

Moreover, a method for performing impurity diffusion in a very shallow area, is known in which laser irradiation (XeCL) is carried out, and in the method, a silicon wafer is scanned by the laser beam having irradiation width of several millimeters. However, such an apparatus using a laser beam is very expensive, and has a problem that throughput thereof is low since the heating treatment is carried out while the surface of the silicon wafer is scanned by a laser beam having a small spot diameter.

Therefore, a method for heating a silicon wafer for an extremely short time, using a flash lamp as a source of heating, has been proposed. In the heating method by the flash lamp, the heat which the silicon wafer receives can be lowered, and irradiation time is very short so that it is very advantageous.

A conventional flash lamp disclosed in, for example, Japanese Laid Open Patent Number 2001-185088, is known. Moreover, a flash lamp irradiation apparatus disclosed in, for example, Japanese Laid Open Patent No. 02-231488, is known.

BRIEF SUMMARY OF THE INVENTION

When such a flash lamp irradiation apparatus in which two or more flash lamps are arranged, is used for a semiconductor manufacturing process, in order to obtain required light intensity on surface of a work piece, such as a silicon wafer, it is necessary to bring the flash lamp close to the work piece. However, if the flash lamps are brought too close to the work piece, brights and darks of light which are called "ripple," corresponding to the intervals (namely, pitch) of the flash lamps which are arranged in parallel occur. The ripple is severely restricted by the semiconductor manufacturing process. Therefore, in order to obtain sufficient intensity on the surface of the work piece, it is necessary to dispose these flash lamps away from a light irradiated surface while the flash lamps with large output is used. However, since in order to irradiate light at high power, the large capacity of a condenser provided in a light emitting apparatus is required so that the lighting apparatus will become large in size, and since the bulb wall loadinging of the flash lamp becomes large, distortion received from the heat and ultraviolet rays of plasma becomes large, so that an arc tube may be damaged in some instances. Or the amount of spatters of an electrode will increase, and, attenuation of the quantity of light takes place due to blackening/cloud in the inner surface of the arc tube, so that duration of a lamp life will become short.

Moreover, a line shaped trigger member is usually used for a conventional flash lamp.

In that case, since light emission is spread from gas near the inner surface of an arc tube under the line shaped trigger member as shown in FIG. 3B, it takes time for the light emission to spread to the arc tube area opposite to the line shaped trigger member, when the arc tube is viewed in a cross sectional view. Therefore, as the pulse width of pulse applied is shorter, it tends to take more time, and in some instances, the light emission won't spread so that light in the opposite side of the line-shaped trigger member dim out. In such a case, light output of the flash lamp itself dims out.

In view of the above problem, an object of the present invention is to provide a flash lamp irradiation apparatus capable of obtaining high intensity light having little ripple on a work piece surface.

Another object of the present invention is to provide a flash lamp irradiation apparatus which is used for a method for manufacturing a semiconductor, liquid display etc.

In view of the above problems, the objects of the present invention are achieved by a flash lamp irradiation apparatus comprising at least one flash lamp having a bulb made of translucent material, two or more trigger members disposed along a tube axis of the flash lamp, wherein voltage is simultaneously impressed to the two or more trigger members at lighting in order to emit light from the flash lamp.

The at least one of the two or more trigger members which is disposed in a side of a work piece may be made of transparent conductor.

The two or more flash lamps may be disposed in parallel, and the flash lamps which adjoin each other may share the trigger member disposed between the adjoining flash lamps.

The bulb may be made of quartz glass, and the flash lamp may be turned on in a condition where $E/(S\cdot\sqrt{T})$ is 470 to 1900 $J/(cm^2\cdot sec^{0.5})$, when a bulb inner surface area is S ($cm^2$), an input energy applied to the flash lamp is E(J), and a pulse width is T (sec).

The bulb may be made of sapphire, and the flash lamp may be turned on in a condition where $E/(S\cdot\sqrt{T})$ is 470 to 3600 $J/(cm^2\cdot sec^{0.5})$, when a bulb inner surface area is S ($cm^2$), an input energy applied to the flash lamp is E(J), and a pulse width is T (sec).

The distance between an undersurface of the flash lamp and the work piece may be 150 mm or less.

Advantages of the present invention will be described below.

According to the present invention, since a flash lamp irradiation apparatus comprises at least one flash lamp having a bulb made of translucent material, two or more trigger members disposed along a tube axis of the flash lamp, wherein voltage is simultaneously impressed to the two or more trigger members at lighting in order to emit light from the flash lamp, even if flash light emission by a pulse having a short width takes place, by impressing high voltage to two or more trigger members simultaneously, light emission is sufficiently spread in a bulb, so that as compared with the case of one trigger member, light intensity becomes large, and even if a flash lamp is brought close to a work piece, it is possible to radiate sufficient light energy to the work piece since the influence of a ripple can be reduced.

Furthermore, since the electric discharge in the lamp grows from two or more places, the effective cross-sectional area of plasma increases so that current density of an effective arc decreases, and the plasma falls in temperature, so that the light emission spectrum of a vacuum ultraviolet region shifts to the long wavelength side.

Consequently, the light (vacuum ultraviolet light) absorbed by the bulb can decrease, light of wavelength band in a range of ultraviolet light which is irradiated to the outside to visible light increases, and irradiance (light intensity on a light irradiated surface) can be raised.

If the at least one of the two or more trigger members which is disposed in a side of a work piece is made of transparent conductor, it is possible to reduce the rate of shading due to a trigger members thereby increasing the amount of light.

If the two or more flash lamps are disposed in parallel, and the flash lamps which adjoin each other may share the trigger member disposed between the adjoining flash lamps, it is possible to reduce the number of trigger members thereby preventing the trigger members from wearing.

If the bulb is made of quartz glass, and the flash lamp is turned on in a condition where $E/(S\cdot\sqrt{T})$ is 470 to 1900 $J/(cm^2\cdot sec^{0.5})$, when a bulb inner surface area is S ($cm^2$), an input energy applied to the flash lamp is E(J), and a pulse width is T (sec), it is possible to realize a flash lamp irradiation apparatus suitable for a manufacturing process of a semiconductor or a liquid crystal display lamp.

If the bulb is made of sapphire, and the flash lamp is turned on in a condition where $E/(S\cdot\sqrt{T})$ is 470 to 3600 $J/(cm^2\cdot sec^{0.5})$, when a bulb inner surface area is S ($cm^2$), an input energy applied to the flash lamp is E(J), and a pulse width is T (sec), it is possible to realize a flash lamp irradiation apparatus suitable for a manufacturing process of a semiconductor or a liquid crystal display lamp, much more than in case that a value of the $E/(S\cdot\sqrt{T})$ is 470 through 3600 $J/(cm^2\cdot sec^{0.5})$. If the distance between an undersurface of the flash lamp and the work piece is 150 mm or less, in a case where two or more trigger members are disposed, the light emitting portion is brought closer to the light irradiated surface as compared with a case where conventional one trigger member is disposed in a side opposite to the light irradiated surface, thereby resulting in effects of making the illuminance higher, light intensity distribution become good at end portions of light irradiated area without decrease of illuminance. Moreover, the entire length of a flash lamp can also be shortened.

Thus, the present invention possesses a number of advantages or purposes, and there is no requirement that every claim directed to that invention be limited to encompass all of them.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE INVENTION

Description of the present invention be given, referring to Embodiments 1-15. While the present invention is not necessarily limited to such embodiments, an appreciation of various aspects of the invention is best gained through a discussion of various examples in such an application.

Embodiments according to the present invention will be given below, referring to FIG. 1 or 8.

Figure 1A:
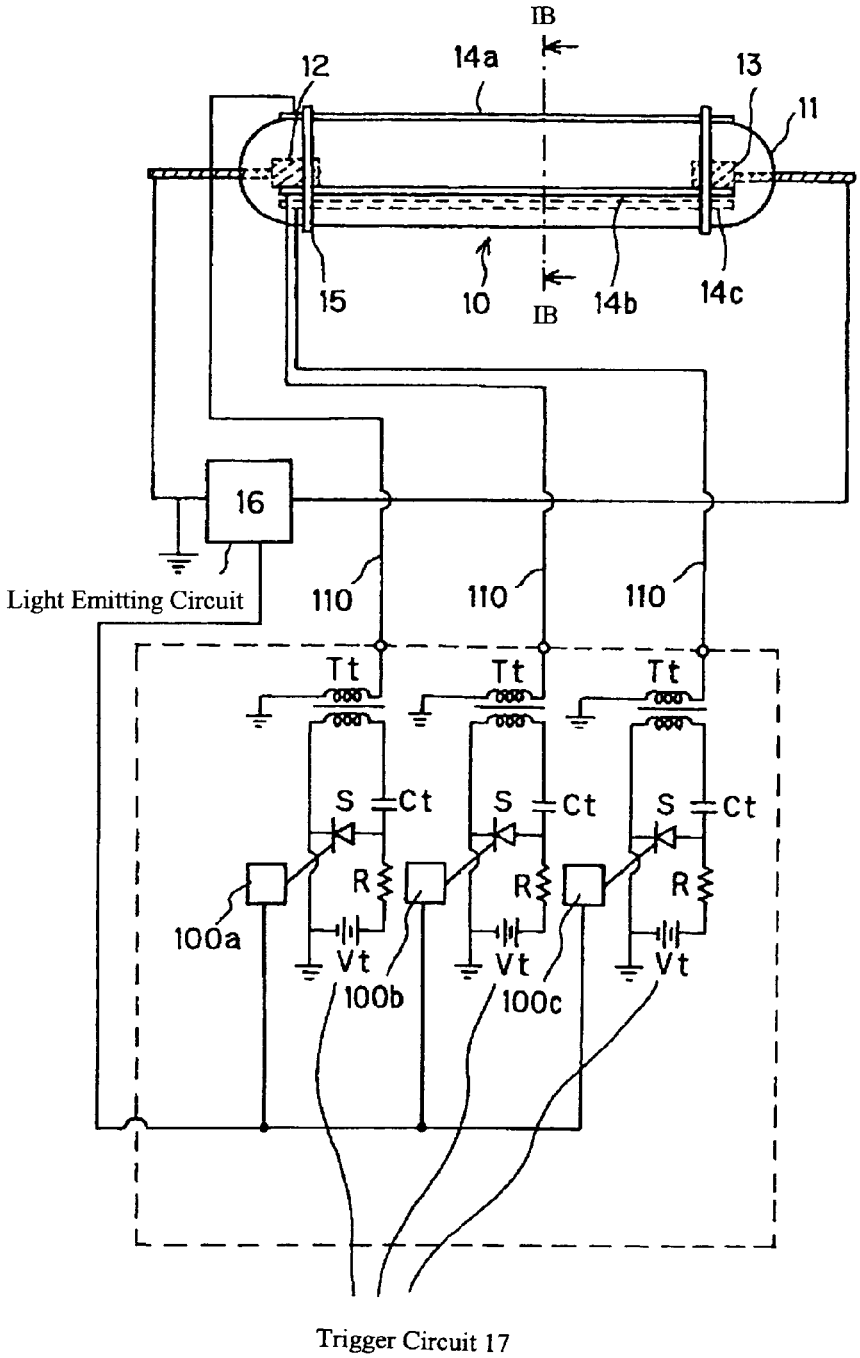
FIG. 1A illustrates the structure of a flash lamp irradiation apparatus in which light from one flash lamp according to an embodiment of the present invention is emitted.
Figure 1B:
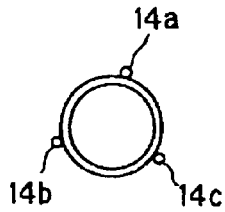
FIG. 1B is a cross-sectional view of the flash lamp taken along a line IB-IB.

FIG. 1A illustrates the structure of a flash lamp irradiation apparatus in which light from one flash lamp according to an embodiment of the present invention is emitted. FIG. 1B is a cross-sectional view of the flash lamp taken along a line IB-IB.

In this figure, for example, xenon gas is enclosed in a straight pipe type electric discharge container 11 of the flash lamp 10, in which the electric discharge container 11 is made from quartz glass, and both ends of the container are sealed in order to form a discharge space inside thereof. In the discharge space, a pair of electrodes comprising a cathode 12 and an anode 13 is disposed so as to face each other. Three line-shaped trigger members 14*a*, 14*b*, and 14*c* are disposed along with a longitudinal direction on an external surface of the electric discharge container 11, and each of the line shaped-trigger members 14*a*, 14*b*, and 14*c* are held by an insulating trigger band 15. These two or more line-shaped trigger members 14*a*, 14*b*, and 14*c* are connected to respective trigger circuits 17, in which trigger voltage from the trigger circuits is synchronously applied to the trigger members 14*a*, 14*b*, and 14*c* at once by a lighting start signal. Light is emitted from the flash lamp 10 at an interval of once a minute, wherein high voltage impressed to each of the line-shaped trigger members 14*a*, 14*b*, and 14*c* is, for example, −15 KV.

Moreover, a condenser(s) for charging and discharging (not shown) is disposed in a light emitting circuit 16, and each of these three trigger circuits 17 is equipped with a trigger coil Tt, a condenser Ct (for example, 0.2 μF), a switching element S, a resistor R, a power supply Vt for trigger charge (for example, 300 V), a drive circuit 100*a*, 100*b*, or 100*c* for the switching element, and a trigger power feeder 110.

In addition, although in this embodiment, the three trigger circuits 17 are provided, in order to simplify the structure of the trigger circuits and the trigger power feeders, one trigger circuit 17 may be provided so as to impress high voltage simultaneously to each of the line-shaped trigger members 14*a*, 14*b*, and 14*c* from the corresponding trigger power feeder 110 by using conductive material (for example, nickel) for the trigger band 15.

Furthermore, the number of the line-shaped trigger members is not limited to three.

Next, an operation of the flash lamp irradiation apparatus will be described below.

First, when a charge start command is sent to the light emitting circuit 16, the condenser for charging and discharging (not shown) is charged in the light emitting circuit 16, and the charged voltage is impressed between the electrodes 12 and 13 of the flash lamp 10. On the other hand, the condenser Ct of each trigger circuit 17 is charged by the power supply Vt for trigger charge (for example, 9 mJ).

Next, if the charging is completed and light emission is ready, a control circuit (not shown) in the light emitting circuit 16 generates a lighting signal. The signal is simultaneously inputted to the drive circuits 100*a*, 100*b* and 100*c* of the respective switching element S, so that all the switching elements S conduct simultaneously.

Consequently, electric charges which are charged in each condenser Ct pass through each switching element S, and flows through the primary side of each trigger coil Tt, thereby generating boosted trigger voltage at the secondary side thereof, so that the boosted voltage is simultaneously impressed to each of the line shaped trigger member 14*a*, 14*b*, and 14*c* through each trigger power feeders 110.

The voltage impressed to each of the line trigger members 14*a*, 14*b*, and 14*c* is impressed to the electrical discharge space through the arc tube of the flash lamp 10, so that gas near the interior surface under the arc tube is slightly ionized. This ionization takes place over the space between the electrodes 12 and 13 of the flash lamp 10. By the ionization, a short-circuit is created between the electrodes 12 and 13, and plasma grows from the positions of ionization, so that the electric charges of the condenser for charging and discharging are discharged at once so that light emission takes place.

An example of the structure of the flash lamp 10 will be described below.

The inside diameter of the electric discharge container 11 is chosen from the range of ϕ 6 mm-ϕ 5 mm, for example ϕ 10 mm, and the length thereof is chosen from the range of 200-580 mm, for example 580 mm. The amount of enclosed gas which is xenon gas is chosen from the range of 6.7 kPa-80.0 k Pa, for example 60 kPa. Moreover, the mainly enclosed gas is not limited to the xenon gas, and argon gas or krypton gas may be used. Moreover, it is also possible to add other substances, such as mercury, in addition to the xenon gas. The electric discharge container 11 is made of quartz glass, alumina, sapphire, YAG, or yttria, etc.

The cathode 12 and anode 13 are mainly made of tungsten or molybdenum, and the outer diameter is chosen from the range of 4-10 mm, for example, 9 mm, and the length thereof is chosen from the range of 5-9 mm, for example, 7 mm. The distance between the electrodes is chosen from the range of 160-500 mm, for example, 500 mm. Moreover, barium oxide (BaO), calcium oxide (CaO), strontium oxide (SrO), alumina ($Al_2O_3$), lanthanum oxide ($La_2O_5$), thorium oxide (ThO), cerium oxide (CeO), etc. are used for the cathode 12 as an emitter.

Moreover, the line-shaped trigger members 14*a*, 14*b*, and 14*c* are disposed covering the entire length of the flash lamp 10, and when two or more line-shaped trigger members need to be electrically insulated from each other, an insulator, such as TEFLON (registered trademark) and a polyvinyl chloride, is used for the trigger bands 15. Moreover, when voltage is applied to the two or more line-shaped trigger members which are at equipotential, metal is used for the trigger bands 15.

Moreover, of the line-shaped trigger members 14*a*, 14*b*, and 14*c*, at least one(s) that are disposed in the side of a work piece may be made from a transparent conductor. In that case, as the transparent electrode, a zinc-oxide film or an ITO (Indium Tin Oxide) film is formed in the arc tube surface with the dipping technology or printing technique.

Figure 2:
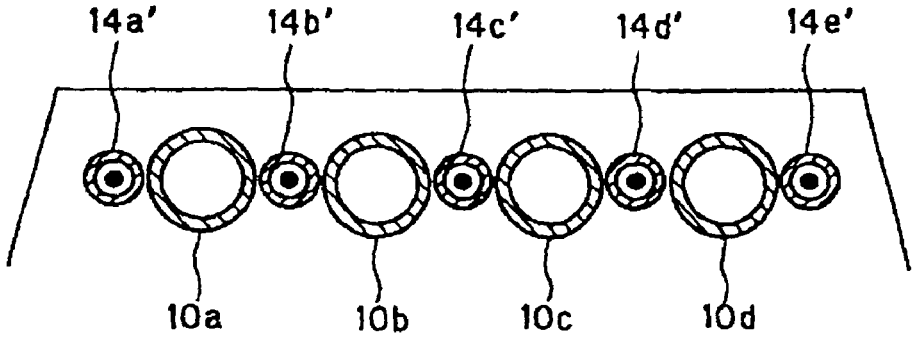
FIG. 2 is a cross-sectional view of the flash lamp taken perpendicular to an optical axis, wherein the two or more line-shaped members of the flash lamp 10 are disposed.
Figure 3:
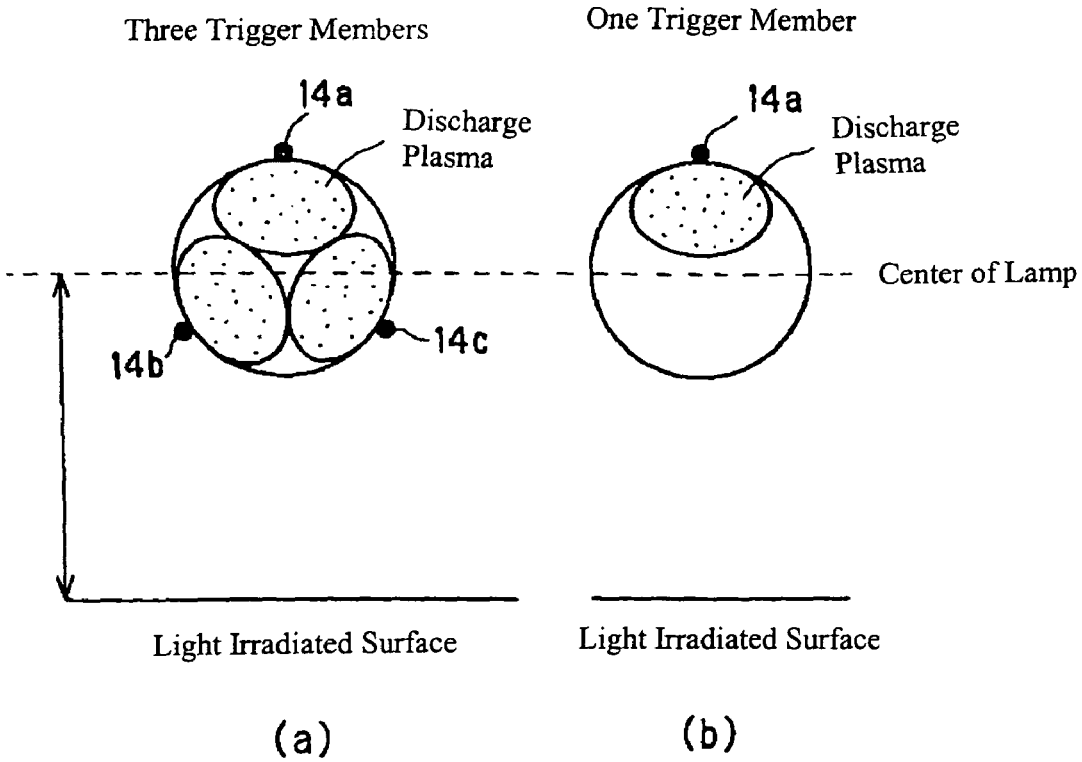
FIGS. 3A and 3B show cross-sectional views, wherein the state of plasma in the bulb of the flash lamp having the three line-shaped trigger members according to the embodiment of the present invention, and the state of plasma of the flash lamp having one line-shaped trigger member of the conventional technology at the time of the electric discharge are shown.

FIG. 2 is a cross-sectional view of the flash lamp irradiation apparatus, taken perpendicular to an optical axis, wherein the two or more (5) line-shaped trigger members and the four flash lamp 10 are disposed.

As shown in the figure, a line-shaped trigger member 14*b′* disposed between the adjoining flash lamps 10*a* and 10*b*, a line-shaped trigger member 14*c′* disposed between the adjoining flash lamps 10*b* and 10*c*, and a line-shaped trigger member 14*d′* disposed between the adjoining flash lamps 10*c* and 10*d*, are shared by the respective adjoining flash lamps.

Next, the reasons why in the flash lamp irradiation apparatus shown in FIG. 1, the optical output obtained from the flash lamp in which the number of line-shaped trigger members is 3, is larger than in case of the flash lamp in which the number of the line-shaped trigger member is 1 will be described below in detail, referring to FIGS. 3 to 6.

FIGS. 3A and 3B show cross-sectional views, wherein the state of plasma in a bulb of the flash lamp having the three line-shaped trigger members according to the embodiment of the present invention, and the state of plasma of the flash lamp having one line-shaped trigger member of the conventional technology at the time of the electric discharge are shown. As shown in these figures, in the flash lamp in which the three line-shaped trigger members are arranged on the respective places of an outer surface of the bulb according to the present invention, electric discharge plasma spreads with sufficient balance to the inside from the wall of the bulb. On the other hand, in the flash lamp in which the line-shaped trigger member is disposed at one place of an outer surface 1 of the conventional bulb, the portion where the plasma occurs inclines toward the inner surface of the bulb near the line-shaped trigger member.

Figures 4, 5:
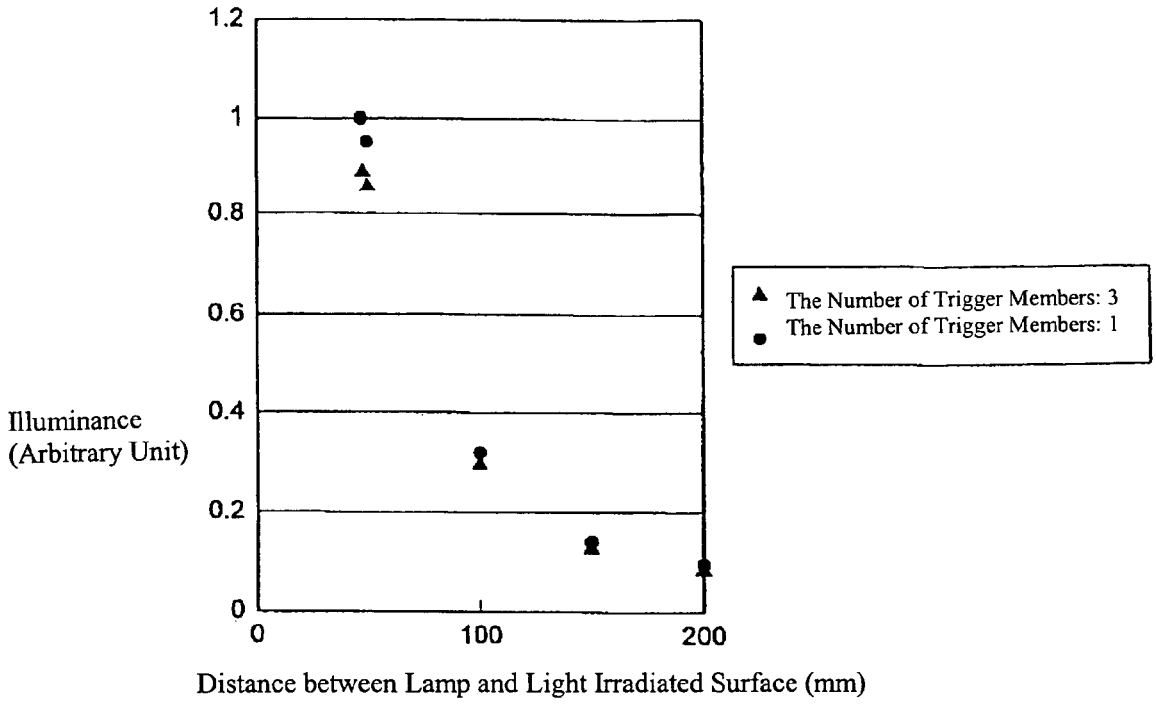
FIG. 4 is a graph showing relationship between the distance from a light irradiated surface to the flash lamp, and the illuminance of the flash lamp, in the flash lamp having the three line-shaped trigger members according to the embodiment of the present invention, and the flash lamp having one line-shaped trigger member of the conventional technology.
FIG. 5 shows the illuminance increasing rates of the flash lamp having the three line-shaped trigger members according to the embodiment of the present invention, and that of the flash lamp having one line-shaped trigger member of the conventional technology.

FIG. 4 is a graph showing relationship between the distance from a light irradiated surface to the flash lamp, and the illuminance of the flash lamp, in the flash lamp having the three line-shaped trigger members according to the embodiment of the present invention, and the flash lamp having one line-shaped trigger member of the conventional technology.

In addition, in the experiment, the inside diameter of the flash lamp was 10.4 mm, the arc length (distance between electrodes) was 110 mm, xenon gas pressure was 60 kPa, the pulse width was 400 μs (microseconds), and input energy was 900 J.

FIG. 5 shows the illuminance increasing rates of the flash lamp having the three line-shaped trigger members according to the embodiment of the present invention, and that of the flash lamp having one line-shaped trigger member of the conventional technology.

As shown in FIGS. 4 and 5, as compared with the case of the one line-shaped trigger member, in the case where the three lined-shaped trigger members were driven simultaneously, the illuminance increasing rate is higher, and especially, the shorter the distance between the flash lamp and the light irradiated surface, the more the light irradiated intensity increases.

Figure 6:
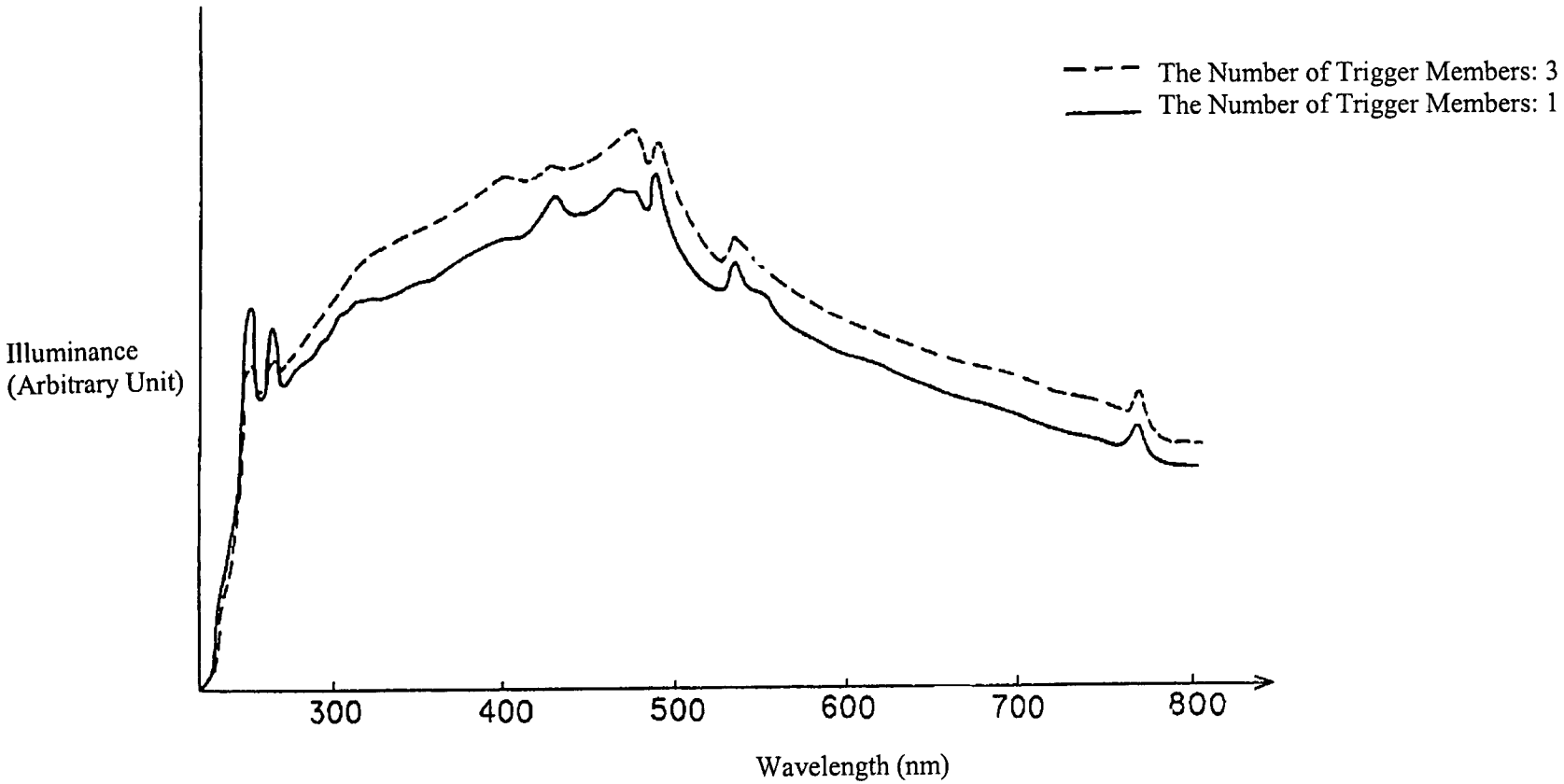
FIG. 6 is a graph showing the change of luminescence intensity to each wavelength in the flash lamp in which the three line-shaped trigger members according to the embodiment of the present invention is used, and in the flash lamp in which the one line-shaped trigger member according to the conventional technology is used.

FIG. 6 is a graph showing the change of luminescence intensity to each wavelength in the flash lamp in which the three line-shaped trigger members according to the embodiment of the present invention is used, and in the flash lamp in which the one line-shaped trigger member according to the conventional technology is used.

As shown in FIG. 6, as compared with the case of the one line-shaped trigger member, in the case where the three lined-shaped trigger members were driven simultaneously, since the electric discharge grows from two or more places in the lamp and the effective cross-sectional area of plasma increases so that the current density of an effective arc decreases and the temperature of plasma falls, the light emission spectrum of a vacuum ultraviolet region shifts to the long wavelength side. Consequently, the light (vacuum ultraviolet light) absorbed by the bulb decreases, and the light in the wavelength band of the range from ultraviolet light emitted outside the bulb to visible light can increases, so that irradiance (light intensity on a light irradiated surface) can be raised.

Next, referring to FIGS. 7 and 8, it will be explained below that as compared with the case of the one line-shaped trigger member, in case of the three line-shaped trigger members, one-side drop is eliminated at an end portion of a wafer (work piece).

Figure 7:
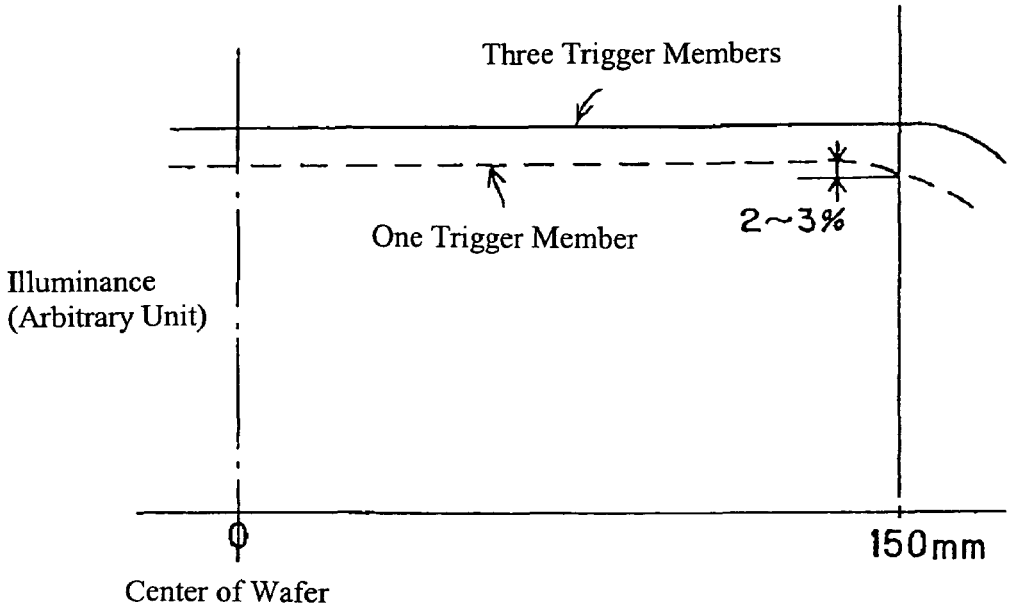
FIG. 7 illustrates illuminance distribution in a radial direction of the wafer in the case of the flash lamp in which the three line-shaped trigger members according to the embodiment of the present invention are used and in the case of the flash lamp in which the one line-shaped trigger member according to the prior art was used, wherein one-side drop of the illuminance at a wafer end portion (150 mm) is shown.

FIG. 7 illustrates illuminance distribution in a radial direction of the wafer in the case of the flash lamp in which the three line-shaped trigger members according to the embodiment of the present invention are used and in the case of the flash lamp in which the one line-shaped trigger member according to the prior art was used, wherein the arc length of a 300 mm wafer was 420 mm, and the distance between the center of the lamp and the wafer was 50 mm. As shown in the figure, in the flash lamp in which the three trigger members according to the present invention were used, it turns out that the one-side drop of the illuminance at the wafer end portion (150 mm) was improved.

Figure 8:
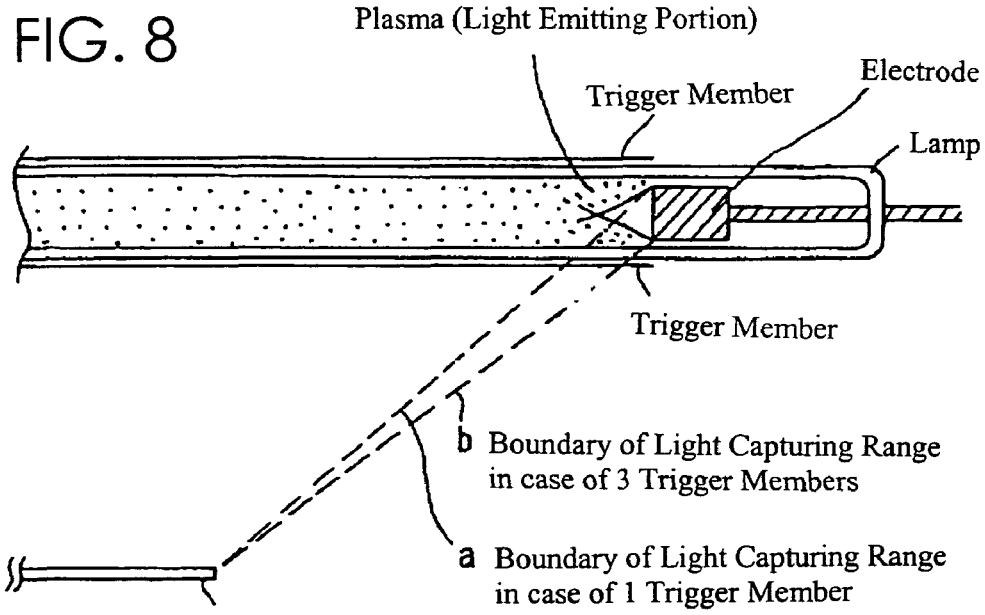
FIG. 8 is a diagram for explaining the reason why the one-side drop of the illuminance at the wafer end portion (150 mm) in the flash lamp having the three line-shaped trigger members according to the embodiment of the present invention is improved.

FIG. 8 is a diagram for explaining the reason why the one-side drop of the illuminance at the wafer end portion (150 mm) in the flash lamp having the three line-shaped trigger members according to the embodiment of the present invention is improved.

In the figure, a dashed line "a" shows the boundary line of the light capturing range in the case of the one line-shaped trigger member, and a dashed line "b" shows the boundary line of the light capturing range in the case of the three line-shaped trigger members.

As shown in the figure, at the wafer end portion (150 mm), when the number of the line-shaped trigger members is one, only the plasma in the inside of the tube wall of the line-shaped trigger member in the upper portion of the arc tube contributes to light emission, but when the number of the line-shaped trigger members is three, plasma spreads throughout the inside of the arc tube, and further, the light emission starting point in the front of the electrode is shifted to the outside from the wafer side, as compared with the case where the number of line-shaped trigger members is one, thereby spreading the light capturing range, so that the illuminance at the end portion (150 mm) of the wafer can be raised, and the one-side drop of the illuminance at the end portion (150 nm) of the wafer can be improved.

Next, it will be explained below why in case that the bulb in the flash lamp is made from quartz glass, $E/(S\cdot\sqrt{T})$ is set to a value in the range of 470 $J/(cm^2\cdot sec^{0.5})$-1900 $J/(cm^2\cdot sec^{0.5})$.

For example, when the input energy E into the flash lamp was 4100 J, the inner surface area S of the lamp was 160 $cm^2$ ($S=\pi$ DL; D=lamp inside diameter 1 cm, the arc length=the distance between the electrodes 50 cm) and pulse width was 800 μS, the value of $E/(S\cdot\sqrt{T})$ became 900 $J/(cm^2\cdot sec^{0.5})$, and when thirty lamps whose center distance was 15 mm were turned on, the irradiation energy density on the wafer surface at 50 mm distance from the center of the lamp was about 25 $J/cm^2$. Under this condition, although the attainment temperature on the silicon wafer surface is affected in some degree by the assistant temperature which warms a wafer from the undersurface, the temperature reaches approximately 1100° C. (degrees Celsius). Thus, a good result that a silicon wafer was activated was obtained.

On the other hand, since the input into the flash lamp is high, the duration of the flash lamp is shortened. Although usually the demanded number of lifetime shots is on the order of $10^5$ (100,000) shots, even taking the safety factor of apparatus into consideration, the number of lifetime shots goes down to below $10^4$ (10,000) shot order when the input energy into the flash lamp was raised. Therefore, the exchange frequency of the flash lamp becomes high and it is not realistic in view of the cost and exchange operation.

Generally, it turns out that the number of times of lamp shots (during the life of the lamp) has correlation with $E/(S\cdot\sqrt{T})$. (For example, ELECTRONIC FLASH, STROBE Third Edition, HAROLD E. EDGERTON work, The MIT Press publication, 1992, 23 pages)

However, these relations are drawn from a result in case that the number of the trigger member is one. Then, the following becomes clear from a result of experiments in the case that two or more line-shaped trigger members were simultaneously turned on.

First, when growth of plasma was observed, it turned out that plasma grew from the electrical discharge space under a trigger line, and when the number of the trigger lines is 2 or more, electric discharge separately occurs at each trigger line, and plasma began to grow all at once from under each trigger line. From the viewpoint, it is thought that the local thermal load under the trigger line determines the lifetime of the lamp, and when the number of the trigger lines is 2 or more, the local thermal load is dispersed, so that the lifetime of the lamp is prolonged.

Based on the above assumption, an experiment for lifetime is conducted by inputting, to the three trigger lines, the same energy as that to the one trigger line (the number of trigger lines is 1). In case of two or more trigger lines, it tunes out that increase of the number of shots at clouding, decrease of distortion accumulated in the arc tube, or the number of shots at breakage, is remarkably improved, when $E/(S\cdot\sqrt{T})$ which is a threshold of lifetime of the lamp was 1900 $J/(cm^2\cdot sec^{0.5})$ in case of the flash lamp made of quartz glass. The burst lifetime of the lamp was on the order of $10^5$ in this range. When the number of the trigger lines is 1, in this range, the arc tube becomes cloudy or loses transparency, due to which breakage occurs on the order of $10^3$ to $10^4$ shots.

For example, when the pulse width T is 400 μS (microseconds), the inner surface area S of the lamp light emission portion is 160 $cm^2$, and the number of trigger lines is 3 ($E/(S\cdot\sqrt{T})$=1875 $J/(cm^2\cdot sec^{0.5})$), cloud of the lamp starts to grow on the $10^4$ shot order when the energy applied to the lamp exceeds 6000 J. Therefore, the intensity of the arc tube is considered to fall gradually and a burst arises at approximately 200,000-300,000 shots.

From the above viewpoint, it turns out that the conditions are optimal when $E/(S\cdot\sqrt{T})$ is 1900 $J/(cm^2\cdot sec^{0.5})$ or less.

Moreover, if the input energy E to the lamp is raised too much when a work piece is a silicon wafer, cracks of the wafer occur. Although the reason is not known well, it is viewed that since the temperature difference between the front and back surfaces of the wafer becomes large so that thermal stress becomes large, cracks (splits and cracks) etc. occur on the wafer surface.

On the other hand, if the energy E is lowered too much, the activation will not be sufficiently performed. Although this condition was also influenced by the assistant temperature, the value of $E/(S\cdot\sqrt{T})$ was 470 $J/(cm^2\cdot sec^{0.5})$ or larger.

According to inventors researches, it turns out that the flash lamp having a bulb made of sapphire, lasts 1.9 times as long as the flash lamp having the bulb made of quartz glass.

For example, when the pulse width T was 100 μS (microseconds), the inner surface area S of the bulb was 35 $cm^2$, the number of trigger lines was 3, and the energy applied to the lamp exceeded 660 J, that is, $E/(S\cdot\sqrt{T})$=1886 $J/(cm^2\cdot sec^{0.5})$, in the case of the lamp made of quartz glass, cloud of the lamp occurred on the $10^4$ shot order as in the above embodiment (in which the lamp is turned on at pulse width of 400 μsec) and the illuminance decreased as it grew and then breakage occurred at approximately 200,000 to 300,000 shots.

On the other hand, in case of the lamp made of sapphire, when the energy applied to the lamp exceeded 1250 J, i.e., $E/(S\cdot\sqrt{T})$=3571 $J/(cm^2\cdot sec^{0.5})$, cracks started to grow on the surface of the arc tube, so that light was scattered thereby decreasing the illuminance, and then breakage occurred frequently at approximately at 200,000 to 300,000 shots.

Moreover, it turned out that the energy to be applied to the lamp can be 1.9 times as much as the flash lamp made of quartz glass, even taking the safety factor into consideration. To be more precise, when a lamp made of quarts glass having the bulb surface area S of 35 $cm^2$ and a lamp made of sapphire having the bulb surface area S of 35 $cm^2$ were turned on at pulse width 100 μsec (microseconds), gradually increasing input energy, breakage occurred in case of the lamp made of sapphire when energy 1.9 times as much as the lamp made of quarts glass was applied to the lamp made of sapphire.

In the case of the flash lamp in which sapphire is used, depending on a work piece to be used or way of using, the value of $E/(S\cdot\sqrt{T})$ in the optimal conditions is deemed to be 3600 $J/cm^2\cdot sec^{0.5}$ or less.

In addition to the activation, there are usages of such a flash lamp, such as, a heat treatment of a SiC substrate which attracts attention as a high melting point material for a power device, crystallization to polysilicon from the amorphous silicon, which is carried out in a manufacture process of a liquid crystal display, and a heat treatment required for ALD (Atomic Layer Deposition) which is the technique of forming, for example, a very thin $SiO_2$ film on the order of atomic layer level in order to improve the dielectric constant of an insulator layer.

In processing these work pieces, energy/bulb wall loading required for a lamp, or the pulse width of light to be emitted varies, but $E/(S\cdot\sqrt{T})$ (J/(cm2, sec0.5)) is the parameter that can systematically treat them.

E/S represents the energy per inner surface area, and is bulb wall loading which is unrelated to time. In the case of the light source which emits pulse light like a flash lamp, it is necessary to consider the element of the time when the inner surface of the arc tube receives energy. Generally, since the diffusion phenomenon (diffusion length) of heat is proportional to the square root of time, standardization thereof can be made by dividing it by T (T; pulse width=half value width of a current wave form).

That is, although lamp input energy, the shape of lamp type, and pulse width changes, when $E/(S\cdot\sqrt{T})$ is constant, the load which a lamp receives is deemed to be the same so that it turned out that similarly it is the same as to the lifetime of a lamp. Further, if it is within the range of these conditions, it turns out that the work pieces in the above examples can be processed.

The disclosure of Japanese Patent Application No. 2004-207598 filed on Jul. 14, 2004 including specification, drawings and claims is incorporated herein by reference in its entirety.

Although only some exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention.

What is claimed is:

1. A flash lamp irradiation apparatus comprising:

at least one flash lamp having a bulb made of translucent material;

two or more trigger members disposed along a tube axis of the at least one flash lamp, wherein voltage is simultaneously impressed to the two or more trigger members at lighting in order to emit light from the at least one flash lamp, wherein at least one of the two or more trigger members which is disposed in a side of a work piece is made of transparent conductor.

2. The flash lamp irradiation apparatus according to claim 1, wherein the bulb is made of quartz glass, and the flash lamp is turned on in a condition where $E/(S\cdot\sqrt{T})$ is 470 to 1900 $J/(cm^2\cdot sec^{0.5})$, when a bulb inner surface area is S ($cm^2$), an input energy applied to the flash lamp is E(J), and a pulse width is T (sec).

3. The flash lamp irradiation apparatus according to claim 2, wherein a distance between an undersurface of the flash lamp and the work piece is 150 mm or less.

4. The flash lamp irradiation apparatus according to claim 1, wherein the bulb is made of sapphire, and the flash lamp is turned on in a condition where $E/(S\cdot\sqrt{T})$ is 470 to 3600 $J/(cm^2\cdot sec^{0.5})$, when a bulb inner surface area is S ($cm^2$), an input energy applied to the flash lamp is E(J), and a pulse width is T (sec).

5. The flash lamp irradiation apparatus according to claim 4, wherein a distance between an undersurface of the flash lamp and the work piece is 150 mm or less.

6. The flash lamp irradiation apparatus according to claim 1, wherein the flash lamps are disposed in parallel, and the flash lamps which adjoin each other share the trigger member disposed between the adjoining flash lamps.

7. The flash lamp irradiation apparatus according to claim 6, wherein the bulb is made of quartz glass, and the flash lamp is turned on in a condition where $E/(S\cdot\sqrt{T})$ is 470 to 1900 $J/(cm^2\cdot sec^{0.5})$, when a bulb inner surface area is S ($cm^2$), an input energy applied to the flash lamp is E(J), and a pulse width is T (sec).

8. The flash lamp irradiation apparatus according to claim 6, wherein the bulb is made of sapphire, and the flash lamp is turned on in a condition where $E/(S\cdot\sqrt{T})$ is 470 to 3600 $J/(cm^2\cdot sec^{0.5})$, when a bulb inner surface area is S ($cm^2$), an input energy applied to the flash lamp is E(J), and a pulse width is T (sec).

9. The flash lamp irradiation apparatus according to claim 7, wherein a distance between an undersurface of the flash lamp and the work piece is 150 mm or less.

10. The flash lamp irradiation apparatus according to claim 8, wherein a distance between an undersurface of the flash lamp and the work piece is 150 mm or less.

* * * * *